United States Patent [19]

Basore

[11] Patent Number: 4,588,154

[45] Date of Patent: May 13, 1986

[54] REMOVABLY-SUPPORTED HAMPER BAG AND SUPPORT FOR SAME

[75] Inventor: Wayne Basore, Cordova, Tenn.

[73] Assignee: Worldsbest Industries, Inc., Memphis, Tenn.

[21] Appl. No.: 657,759

[22] Filed: Oct. 4, 1984

[51] Int. Cl.[4] ..... B65B 67/12

[52] U.S. Cl. ..... 248/99; 150/48; 211/206; 232/30; 248/97

[58] Field of Search ..... 38/10, 33, 35; 248/95, 248/97, 99, 176, 429; 150/49, 51, 48, 50; 220/401, 404; 108/64, 157; 312/184; 232/1 B, 30; 211/123, 162, 175, 206

[56] References Cited

U.S. PATENT DOCUMENTS

| | | | |
|---|---|---|---|
| 354,713 | 12/1886 | Lawson | 150/49 |
| 526,249 | 9/1894 | Meeker | 150/49 |
| 837,148 | 11/1906 | Thompson | 248/97 |
| 1,181,829 | 5/1916 | Bower | 150/49 |
| 1,339,501 | 5/1920 | Dianisha | 108/157 X |
| 1,395,166 | 10/1921 | Tomlinson | 108/157 X |
| 1,731,341 | 10/1929 | Lantz | 248/99 |
| 1,792,406 | 2/1931 | Tomlinson | 108/157 |
| 2,421,221 | 5/1947 | Rothe | 232/30 X |
| 2,457,422 | 12/1948 | Warner | 150/49 |
| 2,468,897 | 5/1949 | Rothe | 232/30 X |
| 2,531,520 | 11/1950 | Lankford, Jr. | 150/48 |
| 2,638,399 | 5/1953 | Seymour | 150/49 |
| 3,556,395 | 11/1968 | Herman . | |
| 3,819,089 | 6/1974 | Scales . | |
| 3,977,450 | 8/1976 | Schauprer . | |
| 3,995,924 | 12/1976 | Jones . | |
| 4,248,364 | 2/1981 | Anderson | 150/51 |
| 4,393,880 | 7/1983 | Taylor . | |
| 4,408,543 | 10/1983 | Griffin | 108/64 X |

FOREIGN PATENT DOCUMENTS

| | | | |
|---|---|---|---|
| 1467884 | 12/1966 | France | 211/206 |

OTHER PUBLICATIONS

Marshall Field Catalogue "January Savings", p. 40.

*Primary Examiner*—William Price
*Assistant Examiner*—Bryon Gehman
*Attorney, Agent, or Firm*—MIlton S. Gerstein; Marvin N. Benn

[57] ABSTRACT

A hamper bag and support for same are disclosed. The hamper bag is flexible, and is supported upon a pair of spaced-apart and parallel support shafts by a pair of support rods inserted in a pair of channels formed in the sides of the upper rim of the flexible bag. The support rods are of such a length that the ends of each support rod protrude outwardly from the ends of the upper rim, so that the protruding ends may rest upon portions of the parallel and spaced-apart support shafts. The pair of support rods are placed parallel to each other, where each support rod is supported at one end upon one end of one of the support shafts, and at the other end at the corresponding end of the other support shaft. The protruding ends of the rods are also provided with grooves for nestling into cooperating grooves in the ends of support shafts, so that the rods may be supported upon the shafts without noticeable relative movement therebetween, yet still allowing for easy and quick removal of the rods from the shafts by lifting the rods with bag attached from the support stand, to thus transport the bag to a remote location, such as a laundry room.

3 Claims, 8 Drawing Figures

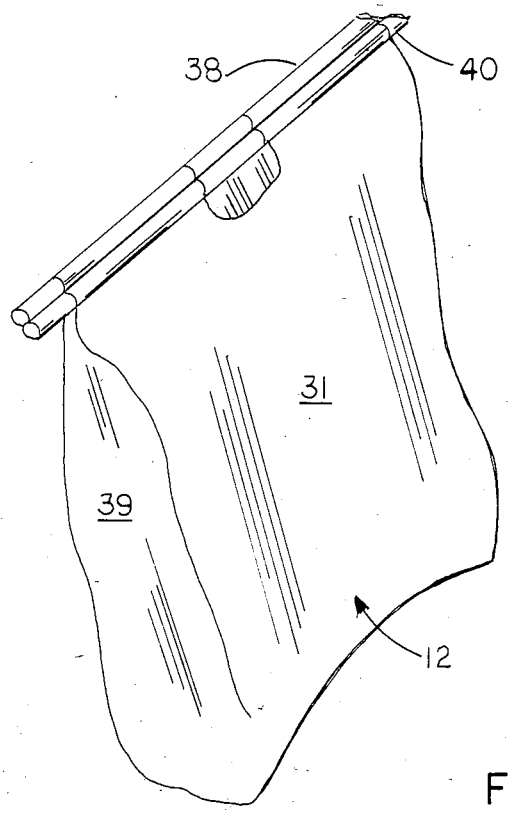
FIG. 6
FIG. 7
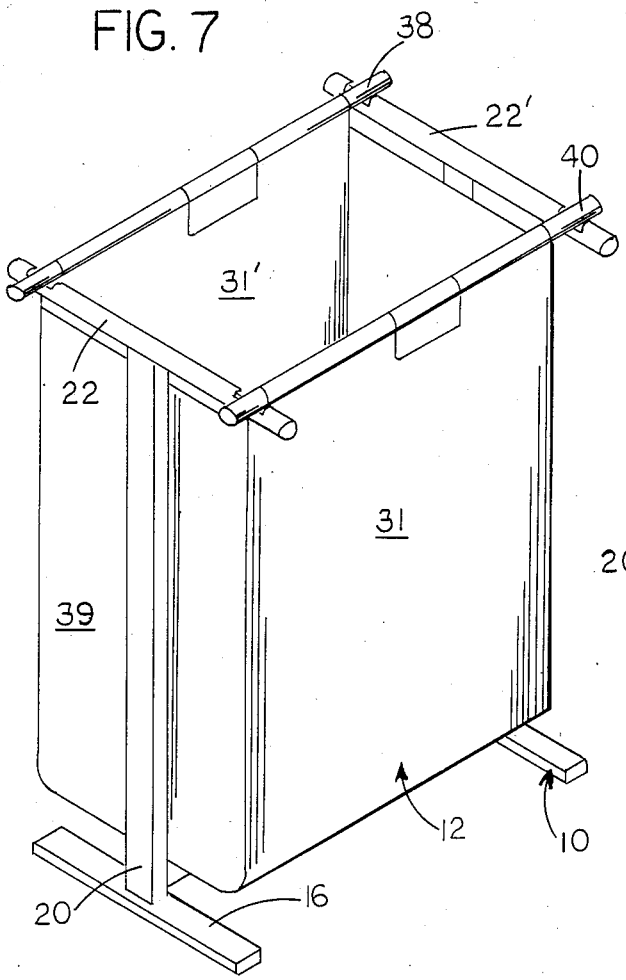
FIG. 8
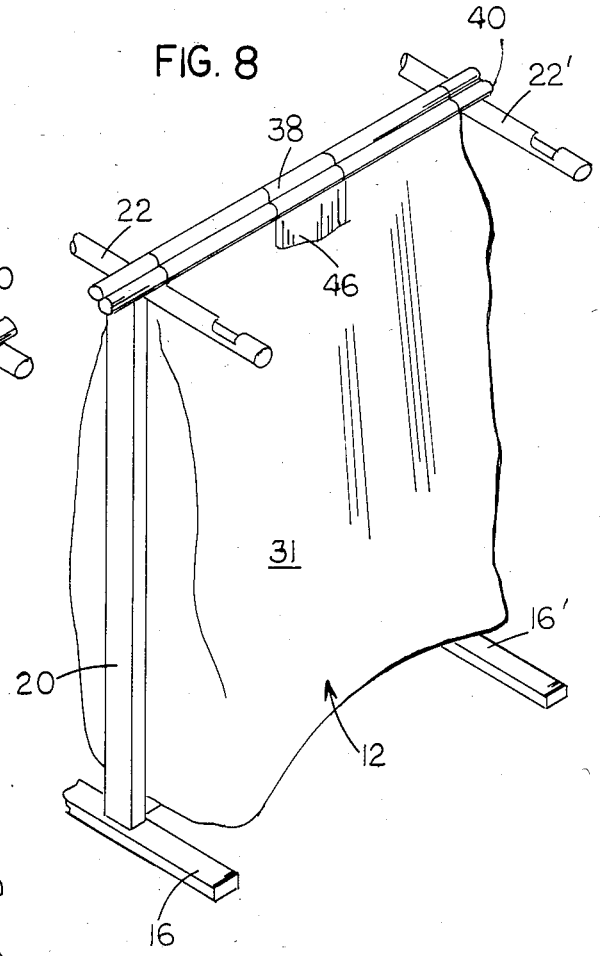

REMOVABLY-SUPPORTED HAMPER BAG AND SUPPORT FOR SAME

BACKGROUND OF THE INVENTION

The present invention is directed to a hamper in which articles of clothing, stored for subsequent laundering, are placed in a bag supported by a stand.

Hampers are well-known. Typically, a hamper contains a storage chamber where the dirty and soiled articles of clothing are stored for laundering at a later date, which storage chamber typically is made of hard, non-flexible material, and closed off at the top by a pivotal lid, which allows selective access to the storage chamber, while preventing an unsightly appearance caused by the dirty clothing, as well as preventing the spreading of malodorous smells. When it comes time to launder the articles of clothing stored in the storage chamber, it has been necessary to first transfer the soiled and dirty, and at times malodorous, items to a secondary transfer bag or basket, which is then carried to the laundry room, or the like, where the soiled and dirty clothing articles are placed in a washing machine for cleaning. Thus, this intermediate step of transferring the articles is not only time-consuming, but can also oftentimes be unpleasant. Further, since the hamper itself is stationary and generally clumsy, and since the interior of the storage chamber is not easily accessible for cleaning, conventional hampers can often become sources of unpleasant odors even without the emplacement of soiled and dirty articles of clothing in them.

SUMMARY OF THE INVENTION

It is, therefore, the primary objective of the present invention to provide a hamper that readily and easily stores soiled and dirty articles of clothing, and the like, for subsequent laundering, but which obviates the secondary step of transferring the soiled and dirty articles of clothing into a secondary transfer bag or basket for subsequent transport to a laundry room, and the like.

It is a further objective of the present invention to provide a hamper that allows easy and fast removal of the storage chamber from the remainder of the structure of the hamper, so that, not only can the soiled and dirty articles of clothing be transported directly to the laundry room by carrying the storage chamber itself from its stationary position attached to the hamper supporting structure, but can also allow easy replacement of the storage structure, as well as for the fast and easy cleaning of the interior thereof.

It is still another objective of the present invention to provide a hamper that can be closed off by a separate and distinct cover portion, or, in the alternative, can be closed by releasably securing together the opposing sides of the upper rim of the hamper storage chamber.

It is still a further objective of the present invention to allow for the very same structure to be used as a waste basket, or the like, in which appropriately-provided bags are used, to be replaced when desired.

Toward these above-ends, the hamper of the present invention is provided with an upstanding supporting stand having a lower base portion provided with legs, in the preferred embodiment of the invention, for standing the hamper on a floor. The supporting stand also has an upper bag-supporting surface made up of a pair of parallel and spaced-apart shafts or dowel-like members, defining between them a hollow space which extends downwardly to the bottom base portion of the supporting stand. Positioned within this hollow space is a flexible hamper bag, which is supported upon the pair of parallel and spaced-apart shafts by a pair of support rods, which support rods extend along opposite side edges of the upper rim of the flexible hamper bag. The pair of rods are releasably secured to the side edges of the upper rim of the flexible hamper bag by channels formed in the side edges, so that each rod may be easily removed by sliding it out from the respective channel in which it is positioned. By providing such easy and fast removal of the support rods from the upper rim of the flexible hamper bag, it is a simple and fast procedure to replace hamper bags at will and when desired.

Each support rod is also provided with a pair of grooves, one groove at each end portion. Each groove cooperates, in the preferred form of this invention, with a groove formed at each end portion of the shafts, thus providing a dovetail-type cooperating connection that allows easy lifting off of the flexible hamper bag by merely drawing together the two support rods along the lengths of the shafts, and gripping the two rods by hand. The upper rim of the flexible bag is also provided with a pair of oppositely-disposed cut-out portions that allow for the insertion therethrough of fingers of a hand, to thereby grip the two support rods for lifting of the rods with attached flexible bag from the pair of shafts of the supporting stand, to carry the bag to the laundry room, or the like.

The hamper of the present invention is also provided with a stiff bottom piece, of substantially rectangular cross-section, which fits into the bottom of the interior of the flexible bag, to give the bottom of the bag structural integrity, to ensure that the bag will stay open and to ensure that it does not easily and readily come off from the support stand. A cover lid portion is also provided for closing off the upper rim of the flexible bag, which upper rim constitutes the mouth of the bag. The cover lid has a central body portion of stiff construction, and a pair of flexible, downwardly-extending flap portions extending from the pair of long side edge surfaces of the central body portion.

The structure of the present invention may also be used to support any type of bag, so that the present invention may be used as a waste basket, or the like. Any appropriate type or size of bag, flexible or non-flexible, may also be used, such that the structure of the present invention allows easy lifting off of the bag from the support stand.

It is also within the purview and scope of the present invention to support the bag by a supporting base structure mounted to a wall, rather than one upstanding from a floor.

BRIEF DESCRIPTION OF THE DRAWING

The invention will be more readily understood with reference to the accompanying drawing, wherein:

FIG. 6 is a perspective view showing the flexible hamper bag in the closed position, with the support rods drawn together into abutting relationship for carrying, by one hand, to a remote site;

FIG. 7 is a perspective view showing the hamper of the present invention with the flexible hamper bag positioned within the hollow space of the support stand of FIG. 1, with the flexible hamper bag shown in its open, article-receiving mode; and FIG. 8 is a perspective view showing the flexible hamper bag in its closed position on the support stand of FIG. 7 for subsequent lifting off of the hamper bag via its support rods, or for preventing unpleasant odors from escaping into the environment, this mode of closing being used as an alternative to the use of the cover lid of FIG. 4.

DETAILED DESCRIPTION OF THE INVENTION

Figure 1:
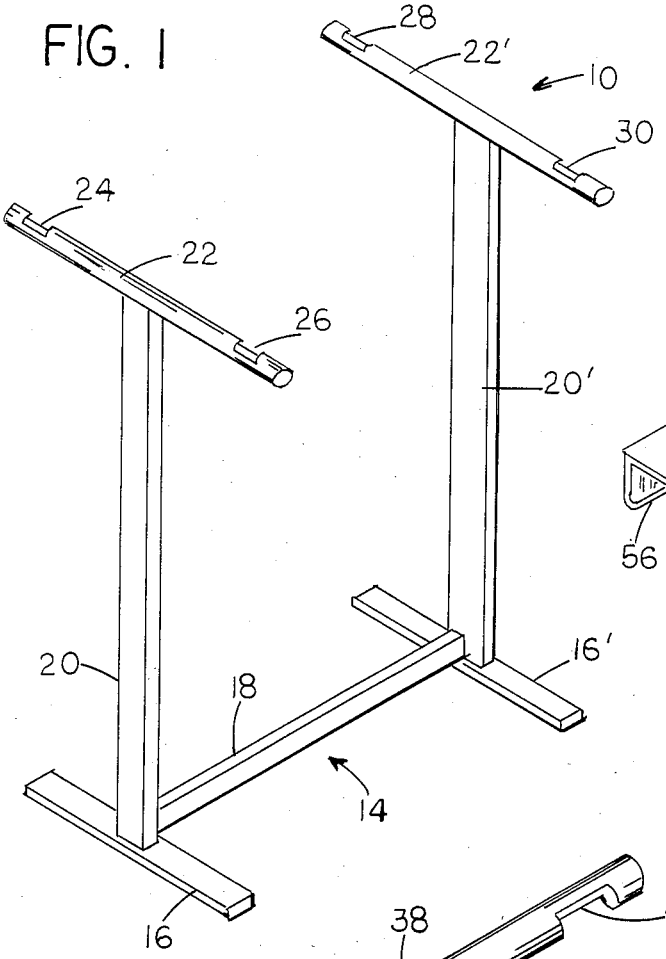
FIG. 1 is a perspective view showing the support stand for the hamper bag of the present invention.
Figure 2:
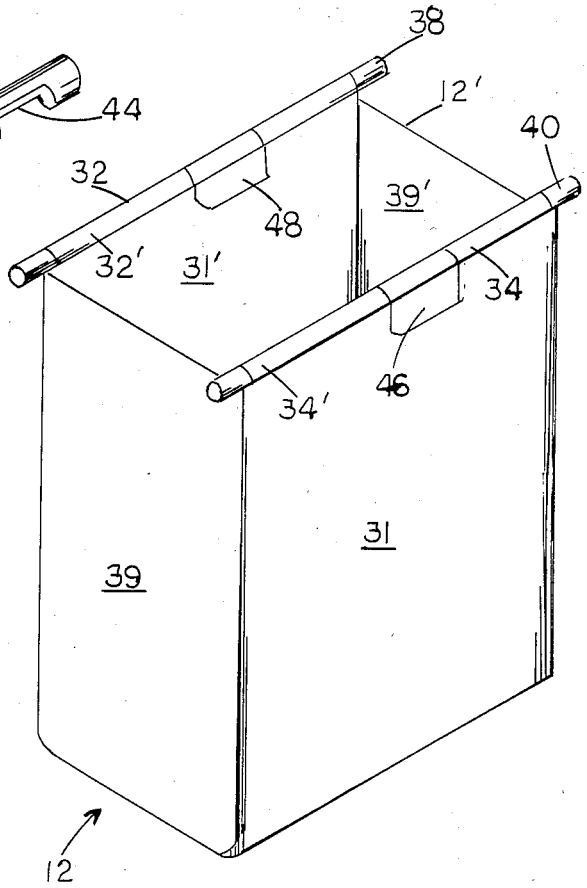
FIG. 2 is a perspective view showing the flexible hamper bag with support rods positioned in channels in the upper rim portion of the hamper bag of the present invention, which support rods mount the hamper bag to the support stand of FIG. 1.

Referring now to the drawing in greater detail, the hamper of the present invention includes a support stand 10 shown in FIG. 1, upon which is placed a flexible hamper bag indicated by reference numeral 12 in FIG. 2. The support stand 10 includes a lower base, floor-supported portion 14 having a pair of feet 16 and 16' interconnected by cross-piece 18. A pair of upstanding, vertically-oriented posts 20 and 20' project upwardly from the feet 16 and 16', respectively. Upon the upper surface of each post 20 and 20' is a support shaft, 22 and 22', respectively, for supporting a pair of support rods connected to the flexible hamper bag 12, to be described below in greater detail. Each shaft 22 and 22' extends parallel to its associated foot 16 and 16'; the shaft 22' is substantially coplanar with the foot 16, while the shaft 22' is substantially coplanar with the foot 16'. Further, the shafts 22 and 22' are substantially coplanar, corresponding portions of each shaft lying in the same horizontal plane.

Each shaft 22 and 22' is provided with a pair of grooves or cut-outs. Grooves 24 and 26 are formed proximate the ends of the shaft 22, while the grooves 28 and 30 are formed in the shaft 22' proximate the ends thereof. The grooves 24 and 28 are coplanar and colinear, while the grooves 26 and 30 are coplanar and colinear. The grooves are used for nesting therein a pair of support rods connected to the flexible bag 12, described below.

The support stand 10, therefore, can be seen to provide a hollow space with boundaries defined at the top thereof by the shafts 22 and 22', at the bottom thereof by the feet 16 and 16', and at the sides thereof by the posts 20 and 20'. Within this hollow space, the flexible hamper bag 12 is positionable for use in storing dirty and soiled articles of clothing, or the like.

Figure 3:
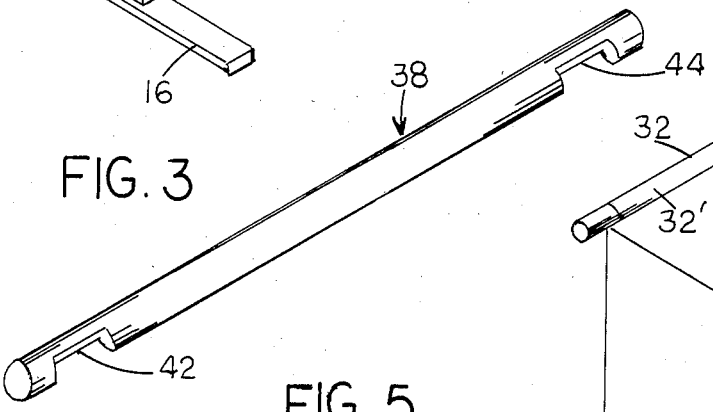
FIG. 3 is a perspective view showing a support rod for insertion into a channel in the upper lip portion of the hamper bag of the present invention.

As shown in FIG. 2, the flexible bag 12 of the present invention has an upper lip or rim portion 12', which upper lip portion has a pair of opposing side edges 32 and 34. Each side edge 32 and 34 has a channel formed therein, indicated by reference numerals 32' and 34', respectively. These channels are formed by a loop at the top of the side edges by doubling the fabric thereof over, and stitching, or otherwise fastening, the extreme edge surface of the doubled-over portion to a respective side surface 31 and 31' of the hamper bag. Each channel 32' and 34' provides a passageway for reception therein of one of the support rods 38 and 40. Each support rod 38 and 40, as shown in FIG. 3, is a substantially-elongated rod member having a length greater than the width of a side surface 31 and 31', so that the end portions of each rod protrude outwardly beyond their respective channel, as shown in FIGS. 2, 6, 7 and 8. Each rod 38 and 40 is formed with a pair of end grooves or cut-outs, similar in construction to the grooves or cut-outs 24, 26, 28 and 30 of the shafts 22 and 22' of the support stand 10. The grooves 42 and 44 of each rod 38 and 40 are of substantially the same size, length and width as the grooves 24, 26, 28 and 30 of the shafts 22 and 22', for cooperation therebetween for snugly nesting the rods 38 and 40 between the shafts 22 and 22', as clearly shown in FIG. 7. The grooves 42 and 44 of each rod 38 and 40 are located adjacent the end portions of their respective shaft, so that they project outwardly beyond the ends of their respective channels and beyond the end surfaces 39 and 39' of the flexible bag 12, as shown in FIGS. 2, 6, 7 and 8. Further, each rod 38 and 40 is removably positionable in a channel, so that each may be easily and readily removed from the channel in which it is positioned. This allows for quick and easy replacement of the bag 12 with another bag similar to it, or one that is dissimilar to it, as long as the replacement bag has the channels 32' and 34' formed in the upper lip thereof.

In using the flexible hamper bag 12 of the present invention, the support rods 38 and 40 are first slipped through the channels 32' and 34', such that the grooves or cut-outs 42 and 44 of each support rod project outwardly of the channel end portions, and such that each groove 42 and 44 of each rod faces downwardly toward the floor. After this initial positioning, the flexible hamper bag, with attached rods 38 and 40, is brought to the support stand 10 and placed thereon by matching the grooves 42 and 44 with the grooves 24, 26, 28 and 30, so that the flexible bag 12 fits into the hollow space of the support stand to serve as a receptacle for storing soiled and dirty articles of clothing, or the like, as shown in FIG. 7.

When resting the flexible hamper bag 12 on the support stand, such is achieved by interconnecting the grooves 42 and 44 of the support rod 38 with the grooves 24 and 28, and interconnecting the grooves 42 and 44 of the support rod 40 with the grooves 26 and 30. Alternatively, the support rod 38 may be positioned between the grooves 26 and 30, while the support rod 40 may be positioned between the grooves 24 and 28. In either case, the distance between the grooves 42 and 44 of each support rod 38 and 40 is approximately equal to the distance between the shafts 22 and 22', taken along a line perpendicular to each shaft, to ensure that the grooves 42 and 44 mesh with the grooves 24 and 28, or with the grooves 26 and 30. Therefore, the support rods 38 and 40, when placed upon the support shafts 22 and 22', are spaced apart along the lengths of the shafts 22 and 22', and extend parallel to each other. The meshing grooves provide interconnection between the flexible bag support rods and the support stand to prevent accidental removal of the bag from the support, but also allowing for quick, easy, and efficient lifting off of the bag 12 with attached support rods from the support stand, for carrying the bag to a laundry room, or the like. FIG. 7 shows the interconnection of the support rods.

In removing the flexible bag 12 from the support stand 10, the pair of rods 38 and 40 are simply drawn toward each other along the shafts 22 and 22' until they are in abutting engagement with each other, as shown in FIG. 8. At this juncture, the pair of rods are held at their mid-sections via cut-out portions 46 and 48 formed in the upper portions of the side surfaces 31 and 31', as shown in FIG. 2. These cut-out portions 46 and 48 allow for the gripping of the two rods 38 and 40 by the fingers of a single hand. After such gripping of the two support rods, at the mid-sections thereof, the flexible bag 12, with attached rods, is carried to a laundry room, or the like, where the contents of the bag are emptied into a washing machine for laundering. After use, the flexible bag, with rods 38 and 40 therein, are transported back to the support stand 10, and placed thereon in the same fashion, with the grooves 42 and 44 meshing with the grooves 24, 26, 28 and 30, and with the support rods 38 and 40 spanning the gap between the shafts, in transverse fashion.

Figure 4:
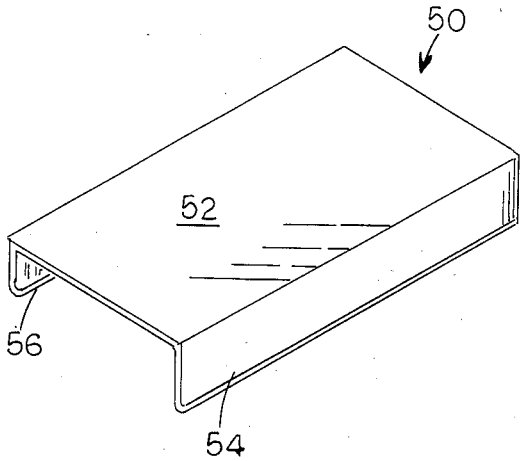
FIG. 4 is a perspective view showing the cover lid for the closing off of the upper lip portion of the hamper bag of the present invention, when the hamper bag is resting in its open position on the support stand of FIG. 1.

FIG. 4 shows a cover lid element that is separate and distinct from the flexible bag 12. This cover lid element 50 is used to close off the mouth of the upper lip of the flexible bag when the bag is mounted to the support stand in the mode illustrated in FIG. 7. The cover lid element 50 has a stiff main body portion 52 that is of substantially the same cross-sectional area as the mouth of the upper lip of the flexible bag, to thereby close off the mouth of the bag, when access to the interior of the bag is not necessary. A pair of flexible, flap portions 54 and 56 are also provided, which flap portions extend normally downward from the long side edges of the main body portion 52. These flap portions 54 and 56 drape over the upper portions of the side surfaces 31 and 31', when the cover lid element is positioned on top of the upper lip, so that each flap portion hides from view one of the cut-out portions 46 and 48. These flap portions 54 and 56 also serve the function of allowing easy gripping of the cover lid element 50, for removing it from the mouth of the bag, to allow access to the interior thereof in order to place dirty or soiled articles of clothing, or the like, therein. The flap portions 54 and 56 are easily pivotal about the long side edges of the main body portion 52, just like flaps.

Figure 5:
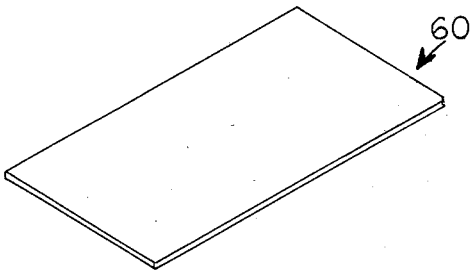
FIG. 5 is a perspective view showing the stiff bottom element for placement in to the bottom of the hollow interior of the flexible bag of the present invention.

FIG. 5 illustrates a stiff bottom element 60 for emplacement into the bottom of the hollow interior of the flexible bag 12. By emplacement of this stiff bottom element into the bottom of the bag 12, the bag is given structural integrity, so that it takes on a definite and defined contour, as shown in FIGS. 2 and 7. When this bottom element is used in the bottom of the bag, the mouth of the bag is generally kept in its open position, due to the stiffness of this element. It is, however, possible to use the flexible bag of the present invention without the bottom stiff element 60, so that the mouth of the bag may be closed off in a manner shown in FIG. 8. In this case, the rods 38 and 40 may be moved along the length of the shafts 22 and 22' into abutting engagement with each other in order to close off the mouth of the bag, to prevent odors from escaping to the environment. In this case, the cover lid element 50 may or may not be used. If it is used, then the closing off of the mouth of the bag is achieved by the cover lid portion 50. If the cover lid portion is not used, then the mouth may be closed off by drawing the two support rods toward each other, in the manner illustrated in FIG. 8, which also sets up the bag for the subsequent lifting off thereof from the support stand 10.

It is also within the scope of the invention to provide a plurality of flexible bags, where the pair of support rods would support such plurality of bags in a series-like arrangement. This would provide the additional possibilities of sorting various elements of the soiled laundry into appropriate categories. Alternatively, each of the flexible bags 12 could be provided with at least one sectional partition to accomplish the sorting.

An additional modification of the invention may be manifested by the provision of elongated support shafts, 22 and 22', such that along the length of each support shaft there are provided a plurality of grooves 24 and 26, so as to accommodate a plurality of support rods 38 and 40 with a plurality of flexible bags 12 connected to the plurality of support rods, such that the support shafts 22 and 22' have emplaced thereon a series of hamper bags in a linear array. This also can be used for sorting colors, types of cleaning, and the like.

The support stand 10 may be made of any appropriate material, such as wood, aluminum, hard plastic, alloy, and the like. The flexible hamper bag 12 is made of any suitable soft or flexible plastic, and the like. The support rods 38 and 40 also may be made of wood, aluminum, plastic, alloy, and the like. It is also within the scope and purview of the present invention to provide a support structure for the flexible hamper bag 12 with attached support rods such that the supporting structure is mountable to a wall, so that the support shafts 22 and 22' project perpendicularly from a wall surface. In this embodiment, the feet 16 and 16' are replaced by suitable braces connecting the posts 20 and 20' to the base of a wall. Further, the posts 20 and 20' may also be dispensed with, and the shafts 22 and 22' may be mounted directly to the wall surface itself.

The flexible bag should be made of a material that allows for the formation, in the upper lip portion thereof, of the channels 32' and 34', so that it may readily accept the support rods 38 and 40. Further, since the support rods 38 and 40 are removably connected to the flexible bag via the channels 32' and 34', any type, size, and quality of bag may be used, at any time. Thus, non-flexible bags may be employed, if the advantage of each removal and gripping by one hand can be dispensed with.

The structure of the present invention is also directly suitable and adaptable for use as a waste basket, or the like. In this instance, the carrying and transport of the bag is not to a laundry room, or the like, but to a waste disposal site. In this use of the invention, the cover lid element 50 may be used, or the bag may be closed off by the method disclosed in FIG. 8. In either case, the bag itself can be carried by simply gripping the two support rods at the mid-sections thereof, as shown in FIG. 6.

While a specific embodiment of the invention has been shown and described, it is to be understood that numerous changes and modifications may be made therein without departing from the scope, intent and spirit of the invention, as set out in the appended claims.

For example, while the Figures show that the mid-sections of the support rods 38 and 40 are visible via the cut-out portions 46 and 48, respectively, so that each channel is, for all intents and purposes, divided into two channel parts or sections, it is to be understood that the mid-sections or portions of the support rods 38 and 40 may be hidden from view by material interconnecting the two channel parts or sections of each channel 32' and 34'. Further, it is within the scope of the present invention to make each channel one long, continuous passageway, rather than a channel subdivided into two channel parts.

What is claimed is:

1. A hamper for storing laundry, and the like, comprising, in combination:

a supporting stand for supporting a hamper bag thereon, said supporting stand having a lower base portion and an upper bag-supporting portion;

bag means having a bag for storing therein laundry, and the like, said bag means further comprising means cooperating with said upper bag-supporting portion of said supporting stand for non-fixedly and removably mounting said bag means to said bag-supporting portion;

said cooperating means comprising a pair of spaced-apart rod members, said rod members passing through channels formed in the side portion of the upper lip of said bag means, each of said rod members having a length greater than the span of said upper lip of said bag means, so that the end of each rod member extends beyond said upper lip at the extremeties thereof from opposite ends of said upper lip to form protruding support end portions by which said bag means is supported on said upper bag-supporting portion of said supporting stand;

said lower base portion comprising a pair of parallel, upstanding posts at the upper ends of which said upper bag-supporting portion is mounted;

said upper bag-supporting portion of said supporting stand comprising a first horizontally-extending shaft and a second horizontally-extending shaft parallel to and spaced from said first shaft to define therebetween a hollow space, said hollow space extending downwardly toward said lower base portion, such that when said bag means is mounted to said supporting stand, said bag means occupies at least a portion of said hollow space, said first shaft being mounted to the upper end of one of said upstanding posts, and said second shaft being mounted to the other of said upstanding posts, such that the longitudinal axis of each of said first and second shafts extends perpendicularly to the vertical axis of its respective said upstanding post;

each of said rod members spanning the distance between said spaced-apart first and second shafts in a transverse direction such that said protruding support end portions of each of said rod members are supported by said first and second shafts, said first shaft supporting one said support end portion thereon, and said second shaft supporting the other end portion thereon, such that said rod members extend parallel to each other and spaced from each other along lengths of said first and second shafts;

each of said protruding support end portions of each of said rod members comprising a first groove means for receiving therein a mating portion of one of said first and second shafts, the distance between said first groove means of a respective one of said rod members being approximately equal to the transverse distance between said parallel and spaced-apart first and second shafts, so that said first groove means fits over corresponding mating portions of said first and second shafts;

each said mating portion of each of said first and second shafts comprising a second groove means for cooperating with one of said first groove means in said rod members, whereby said first and second groove means hold the bag to said supporting stand;

said bag being made of flexible material so that said upper lip thereof may be closed by drawing together said rod members toward each other, each of said first groove means of said rod members allowing said rod members to be drawn toward each other to close off said bag by riding along said first and second shafts until said rod members are in close proximity to each other thereby closing off said upper lip of said bag;

said upper lip of said bag comprising a pair of oppositely-disposed cut-out portions, one cut-out portion lying directly beneath the center portion of one of said rod members when said rod members are mounted in said upper lip, and the other cut-out portion lying directly below the center portion of the other rod member when said rod members are mounted in said upper lip, said cut-out portions constituting openings through which the fingers of a hand may extend for gripping said rod members when drawn together for closing off the upper lip, to thereby lift up said bag from said first and second shafts and carry the bag to a laundry room, or the like; and each of said cut-out portions dividing the channel of its respective side portion of said upper lip into two channel sections, such that, when a respective one of said rod members is positioned in a channel on one side of said upper lip, the center portion thereof is exposed by the respective cut-out portion, said center portion lying between the adjacent ends of said two-channel sections of the respective side of said upper lip.

2. The hamper according to claim 1, further comprising a removable cover portion for said bag for closing off the upper, open portion of said bag when said bag is mounted to said first and second shafts by said rod members, so that the contents of said bag are not seen, said cover portion comprising a stiff, flat, main body portion of substantially quadrilateral cross-section having a first side edge surface and a second side edge surface that are parallel to said first and second rod members when said cover portion is mounted on said bag; said cover portion further comprising at least one pivotal flap portion privotally connected to at least one of said first and second side edge surfaces of said main body portion, so that at least one said flap portion extends over one of said rod members associated therewith, whereby said bag is closed off.

3. The hamper according to claim 1, comprising two said flap portions, one being pivotally connected to one of said side edge surfaces of said main body portion, and the other being pivotally connected to the other of said side edge surfaces of said main body portion, whereby both of said rod members are hidden from view, and by which said main body portion may be more easily removed.

* * * * *

UNITED STATES PATENT AND TRADEMARK OFFICE

CERTIFICATE OF CORRECTION

PATENT NO. : 4,588,154

DATED : MAY 13, 1986

INVENTOR(S) : WAYNE BASORE

It is certified that error appears in the above-identified patent and that said Letters Patent is hereby corrected as shown below:

Column 1, line 49, "structure" should be -- chamber --;

Column 3, line 67, "34'." should be -- 34', --;

Column 6, line 46, "each" should be -- easy --.

Column 8, line 57, "claim 1" should be -- claim 2 --.

Signed and Sealed this

*Sixteenth* Day of *September 1986*

[SEAL]

*Attest:*

DONALD J. QUIGG

*Attesting Officer*

*Commissioner of Patents and Trademarks*